United States Patent [19]

Kamp et al.

[11] 4,154,411

[45] May 15, 1979

[54] METHOD AND DEVICE FOR INCREASING THE SPEED AT WHICH TAKE-UP COILS ARE EXCHANGED IN A WINDING MACHINE FOR TEXTILE THREADS

[75] Inventors: Heinz Kamp, Rickelrath; Hans Raasch, Monchen-Gladbach, both of Fed. Rep. of Germany

[73] Assignee: W. Schlafhorst & Co., Monchen-Gladbach, Fed. Rep. of Germany

[21] Appl. No.: 658,622

[22] Filed: Feb. 17, 1976

[30] Foreign Application Priority Data

Feb. 14, 1975 [DE] Fed. Rep. of Germany ..... 2506291

[51] Int. Cl.[2] ..... B65H 54/20; B65H 54/26

[52] U.S. Cl. ..... 242/35.5 R; 242/18 R; 242/18 DD; 242/18 PW; 242/35.5 A; 242/35.6 R

[58] Field of Search ..... 242/35.5 R, 35.5 A, 242/35.6 R, 18 R, 18 DD, 18 PW

[56] References Cited

U.S. PATENT DOCUMENTS

| | | | |
|---|---|---|---|
| 1,267,977 | 5/1918 | Colman | 242/35.6 R |
| 1,268,684 | 6/1919 | Colman | 242/35.6 R |
| 1,700,425 | 1/1929 | Abbott et al. | 242/35.6 R |
| 2,757,874 | 8/1956 | Marcellus | 242/35.6 R |

*Primary Examiner*—Stanley N. Gilreath
*Attorney, Agent, or Firm*—Herbert L. Lerner

[57] ABSTRACT

Method of increasing the speed at which take-up coils are exchanged at winding stations of a winding machine for textile threads which includes, prior to exchanging a take-up coil at a respective winding station, winding a few thread windings on a coil core to form a starter coil in a winding device separate from the respective winding station, exchanging a fully wound take-up coil at the respective winding station for the starter coil previously formed on the separate winding device; tying a thread end of the starter bobbin to a thread end of a supply coil fed to the respective winding station; and setting the respective winding station in operation for winding thread on the starter coil to form a fully wound take-up coil; and device for carrying out the foregoing method.

24 Claims, 17 Drawing Figures

FIG. 5
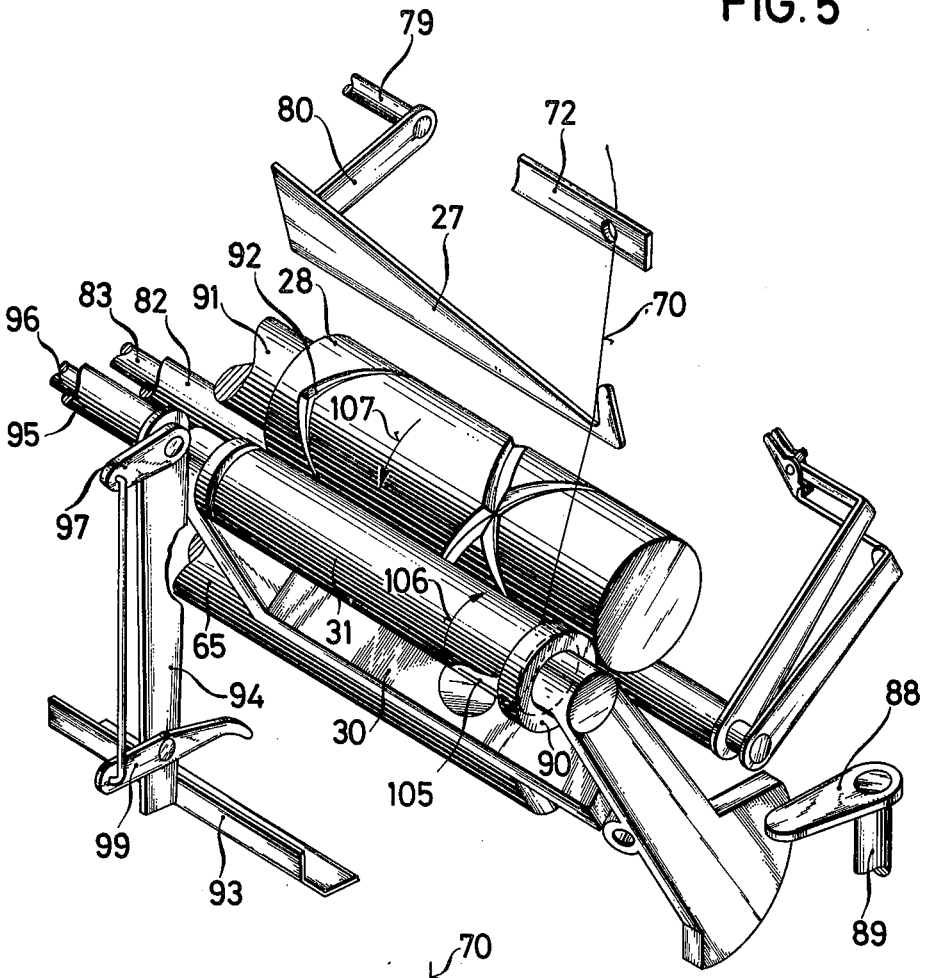
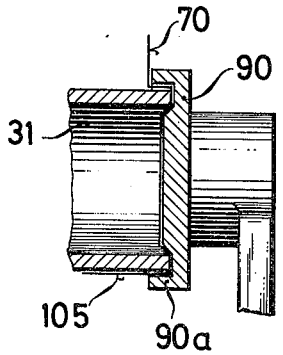
FIG. 5a

FIG. 9
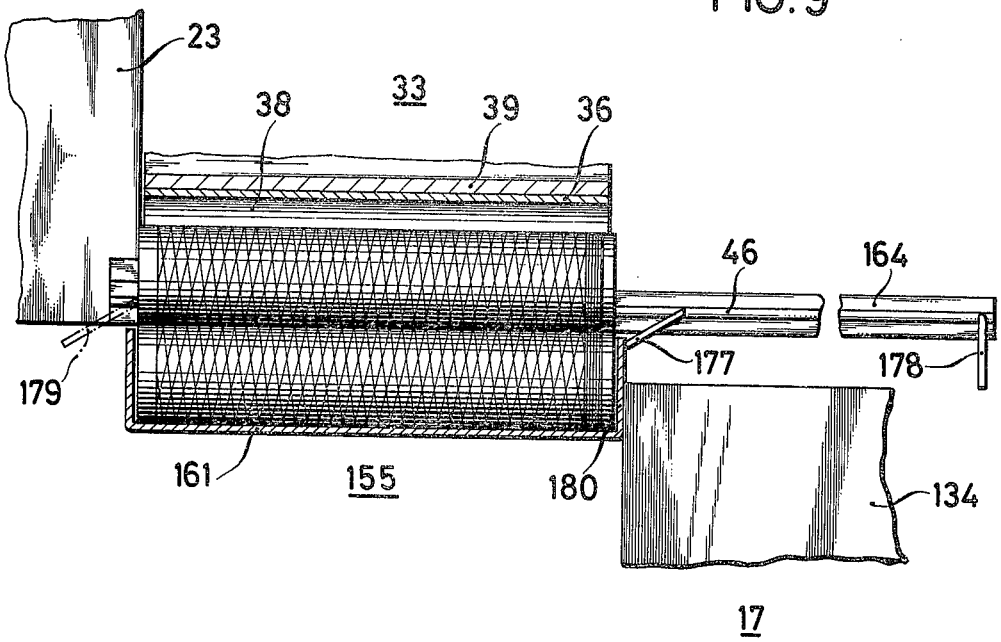
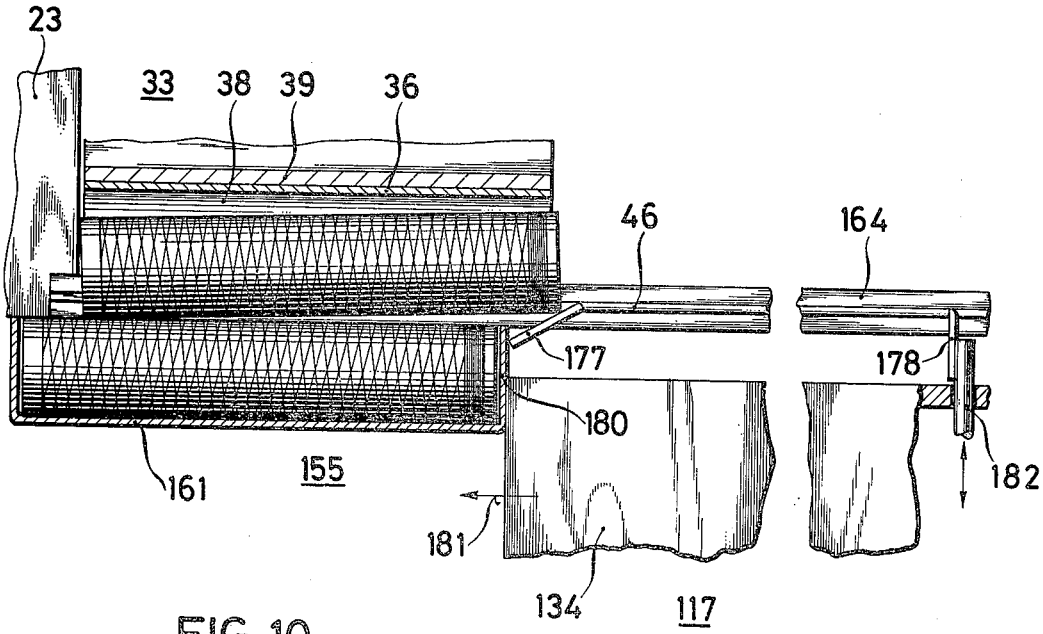
FIG. 10

FIG. 12
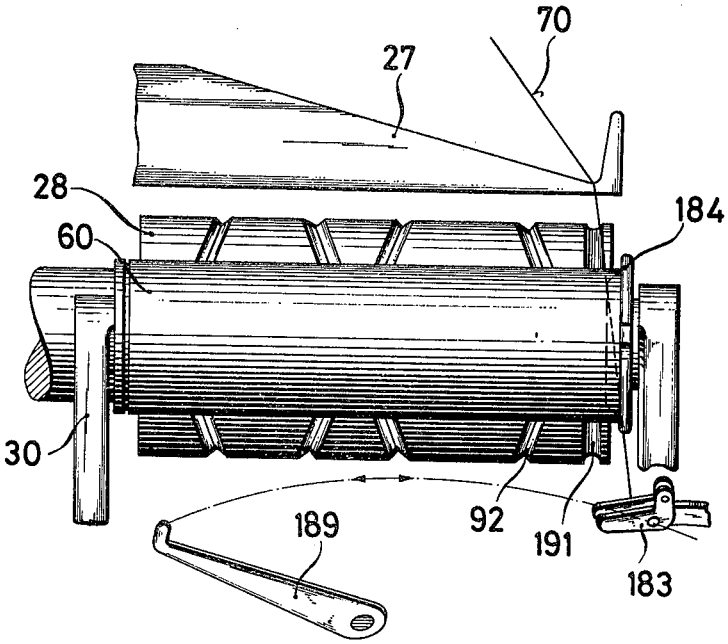
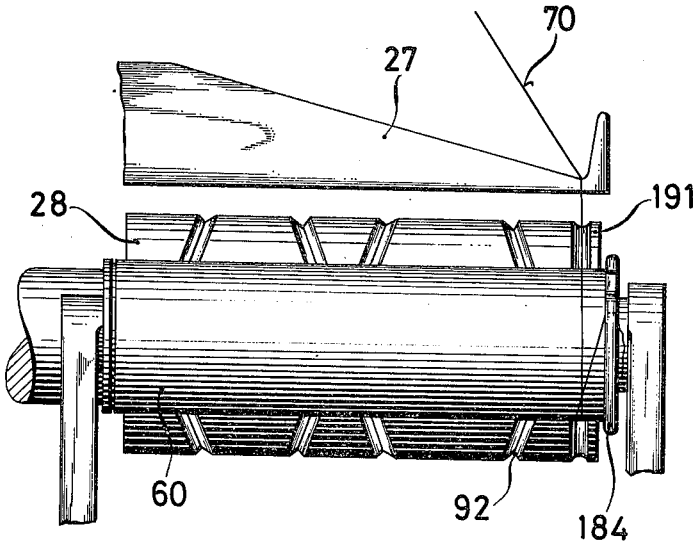
FIG. 13

FIG. 14
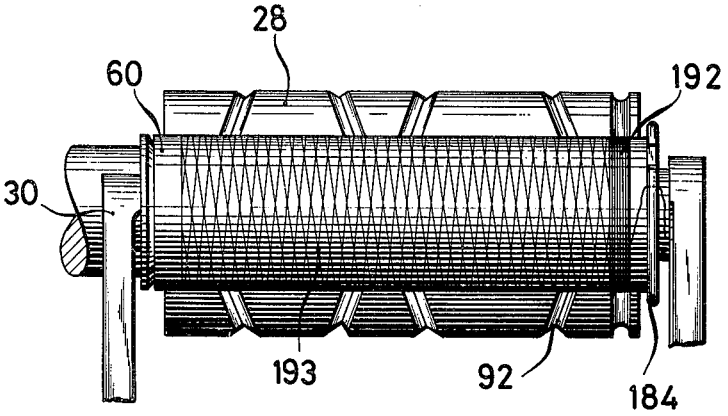
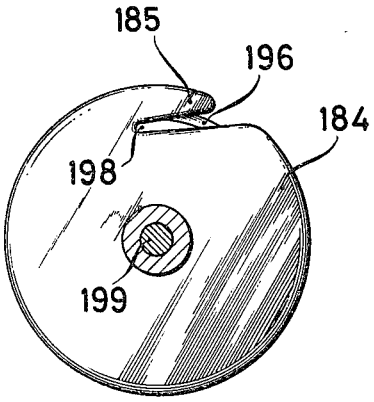
FIG. 15
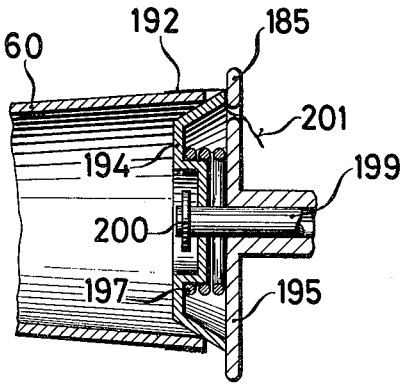
FIG. 16

METHOD AND DEVICE FOR INCREASING THE SPEED AT WHICH TAKE-UP COILS ARE EXCHANGED IN A WINDING MACHINE FOR TEXTILE THREADS

The invention relates to method and apparatus for increasing the speed at which take-up coils for textile threads are exchanged in a winding machine. When exchanging take-up coils, the fully wound coil has heretofore been exchanged for an empty or fully unwound core or tube. Only on occasion have partially wound coils of varying fullness also been inserted again, in addition, and further wound to completion or to their full size. In either situation, one must accept a loss of efficiency. Either the time necessary for joining the thread at the start and for forming the thread reserve was lost, or the exchange of the coils at all of the work stations was required in such rapid sequence that waiting or delay periods had to be provided because the coil-exchanging devices of the type generally traveling from work station to work station were overloaded. In addition, the exchange of fully wound coils present special construction problems as against coils of varying fullness.

The invention avoids all these disadvantages. It is accordingly an object of the invention to provide a method and device for accelerating or increasing the speed at which take-up coils for textile threads are exchanged in a winding machine which avoid the foregoing disadvantages of previously known methods and devices of these general types.

With the foregoing and other objects in view, in accordance with the invention, starter coils are formed in a separate winding device before the take-up coils are exchanged, the starter coils being formed of a coil core or tube having a few thread windings wound thereon, a securely fixed starting end of the thread and, if desired, a thread reserve; the fully wound take-up coil is exchanged at a respective winding station by one of the starter coils; the end of the thread of the starter coil is then tied to the thread end of the supply coil at the respective winding station, the winding station is set into winding operation.

In accordance with a further feature of the invention, the starting end of the thread is secured by overwinding when forming the thread reserve.

In accordance with another feature of the invention, the method comprises, after inserting an unwound core into the separate winding device but before clamping the core in the separate winding device, guiding the thread to be wound in a few windings thereon initially across the end face of the core, preferably intersecting with the axis of the core, then clamping the core with a clamping device at the end face thereof so that the thread is clamped therebetween with a free end thereof disposed along the winding surface of the core for overwinding the same when forming the thread reserve.

In accordance with a further feature of the invention, the method comprises withdrawing the thread to be wound in the separate winding device from a supply coil by means of clamping shears and a thread gripper and delivering the thread into a region wherein it is interceptible by a thread capturing and clamping device located at a support frame for the core, gripping the thread by means of the catching and clamping device while the coil core is simultaneously rotated, pulling the thread end out of the clamping shears and securing it to the coil core so that it can be overwound when forming the thread reserve.

In accordance with another feature of the invention, the method comprises winding the starter coil at one end of the winding machine at which the separate winding device is located.

In accordance with an added feature of the invention, the method comprises winding the starter coil at a location of the winding machine at which the separate winding device is located, the separate winding device being selectively usable as a winding station of the winding machine.

In accordance with an additional feature of the invention, the method includes intermittently filling a magazine for starter coils to be exchanged for the fully wound take-up coils at the respective winding stations with starter coils formed in the separate winding device.

In accordance with yet another feature of the invention, the method includes intermittently delivering a plurality of the starter coils simultaneously from the separate winding station to a traveling coil exchanging device with which the magazine is associated.

In accordance with an alternate feature of the invention, the method including initially storing the starter coils formed in the separate winding device in another magazine associated with the separate winding device and thereafter filling the first-mentioned magazine with the starter coils from the other magazine.

In accordance with another feature of the invention, the method includes feeding the starter coils directly from the separate winding device to the respective winding stations of the winding machine.

In accordance with an alternate feature of the invention, the method includes initially storing the starter coils formed in the separate winding device in a magazine associated with the separate winding device, and thereafter feeding the stored starter coils from the magazine directly to the respective winding stations of the winding machine.

In accordance with a concomitant feature of the invention, the method includes holding the starter coils in readiness at the respective winding stations of the winding machine prior to exchanging the fully-wound take-up coils therewith.

In accordance with the invention, the device for performing the method comprises separate winding means associated with the winding machine for forming starter coils having a few thread windings thereon.

In accordance with another feature of the invention, the separate winding means for forming starter coils is located at one of the winding stations of the winding machine.

In accordance with a further feature of the invention, the separate winding means are located at one end of the winding machine.

In accordance with an added feature of the invention, the separate winding means comprise a magazine for storing at least one of the formed starter coils therein.

In accordance with an additional feature of the invention, a traveling coil exchanging device is provided that is movable from winding station to winding station for exchanging fully wound take-up coils wound at the respective stations, the coil exchanging device having a magazine for receiving therein at least one starter coil formed by the separate winding means.

In accordance with yet another feature of the invention, a magazine is located at each of the winding stations for at least one of the starter coils formed by the separate winding means.

In accordance with yet a further feature of the invention, the separate winding means include thread guiding means for winding a thread reserve on the respective cores at one side thereof, and means for securing the thread end in the wound thread reserve.

In accordance with another feature of the invention, the separate winding means include thread guiding means for securing the starting end of the thread by overwinding.

In accordance with a further feature of the invention, the separate winding means include clamping means for clamping the thread against the end face of the coil core and for diverting the starting end of the thread in a direction along the cylindrical surface of the core.

In accordance with yet another feature of the invention, the separate winding means include means for carrying the coil core, the coil-core carrying means having a thread-capturing and clamping device.

In accordance with yet a further feature of the invention, the thread capturing and clamping device comprises a catch projection extending from the coil-core carrying means in a direction wherein the coil core is rotatable.

In accordance with another feature of the invention, the thread clamping device is automatically releasable upon the release of the respective coil core.

In accordance with a further feature of the invention, the coil-core carrying means comprise a centering cone and a clamping member movable relatively toward and away from one another, both the centering cone and the clamping member having mating engagement surfaces in a mutual region of engagement.

In accordance with an added feature of the invention, the device for performing the method includes at least one energy storage device disposed between and separating the centering cone and the clamping member.

In accordance with an additional feature of the invention, the energy storage device is a compression spring.

In accordance with more specific features of the invention, the catch projection is located at the periphery of the clamping member, the catch projection and the clamping member defining a thread capturing slot therebetween, the slot intersecting with the engagement surface of the centering cone at an acute angle.

In accordance with a concomitant feature of the invention, the device includes clamping shears located directly behind the core carrying means in thread withdrawal direction.

The free end of the starting end of the thread, initially provided at the beginning of the winding up of the thread reserve, should preferably not exceed a length of 15 to 20 millimeters, so as not to cause disturbances or disruption in the windings. Therefore, as aforemention, the clamping shears are located immediately behind the tube carrier, as viewed in the withdrawal direction of the thread.

The advantages of the invention are seen particularly in the fact that the exchange of coils is accelerated or occurs at increased speed because the thread reserve has already been formed before the coils are exchanged. At the respective work stations of the winding machine, no special devices for inserting partially filled or wound coils of verying fullness or for forming the thread reserve and for securing the starting end of the thread are required any longer.

All use of remainder coils i.e. partially wound coils, is held back from the winding machine. The frequent thread breaks associated therewith in the region of the winding remainder which is highly stressed repeatedly by starting and tying processes, are thereby advantageously eliminated. Remainder coils or partially wound coils are better utilized to advantage by unwinding the remainder of of the winding therefrom. This simultaneously eliminates the problem of progressive soiling of the residual winding.

Other features which are considered as characteristic for the invention are set forth in the appended claims.

Although the invention is illustrated and described herein as embodied in method and device for increasing the speed at which take-up coils are exchanged in a winding machine for textile threads, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIGS. 3, 4, 5, 6 and 7 are enlarged fragmentary perspective views of the separate winding device of FIG. 2 during different modes of the operation thereof, and FIG. 5*a* is a fragmentary sectional view of a coil and the pivotable frame or holder thereof;

FIGS. 9 and 10 are enclarged diagrammatic views, partly in section of the magazines of the special winding device and the take-up coil-exchanging device shown in FIG. 1;

Figure 1:
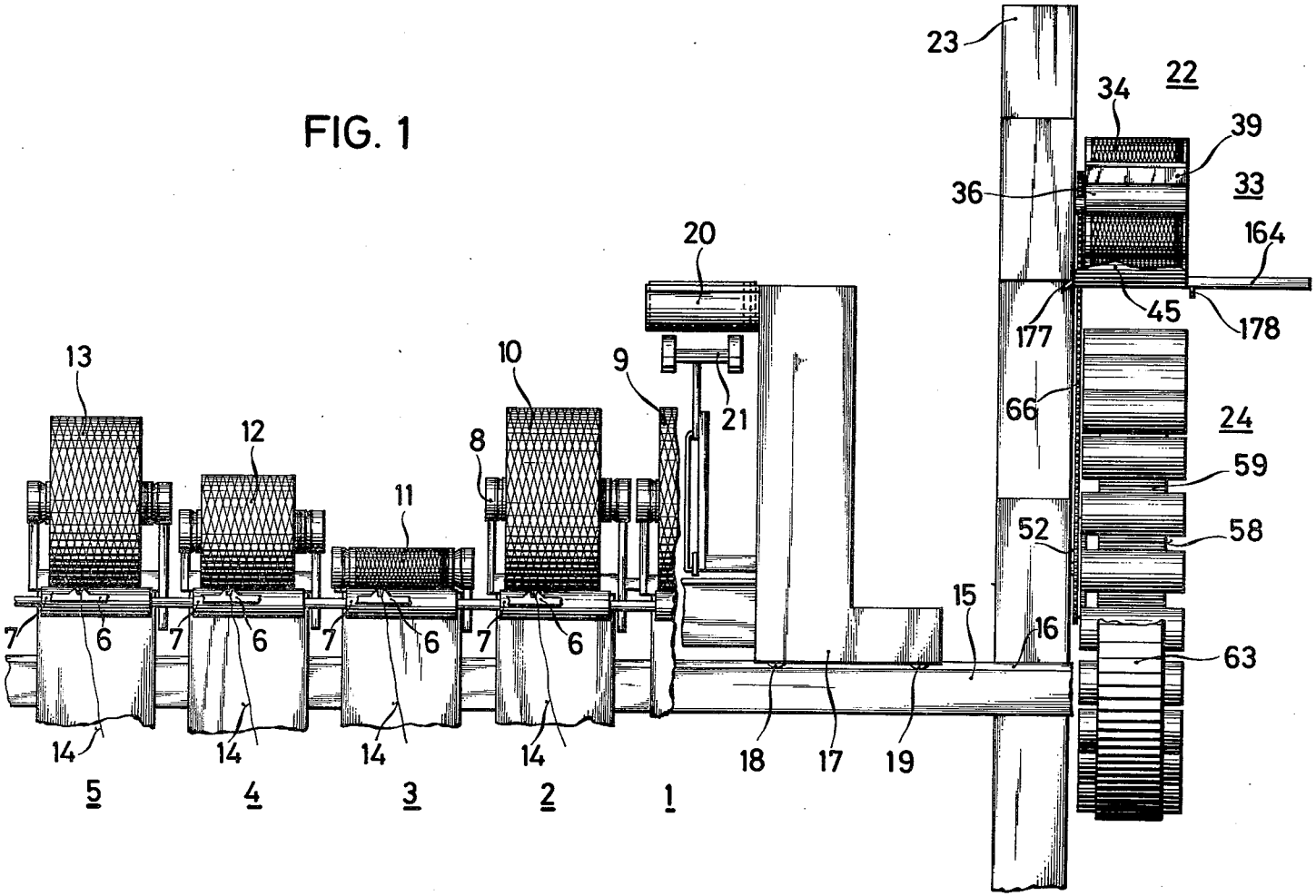
FIG. 1 is a diagrammatic side view of a winding machine with several correlated winding stations, a traveling take-up coil-exchanging device and a special, separate winding device for producing starter coils.
Figure 11:
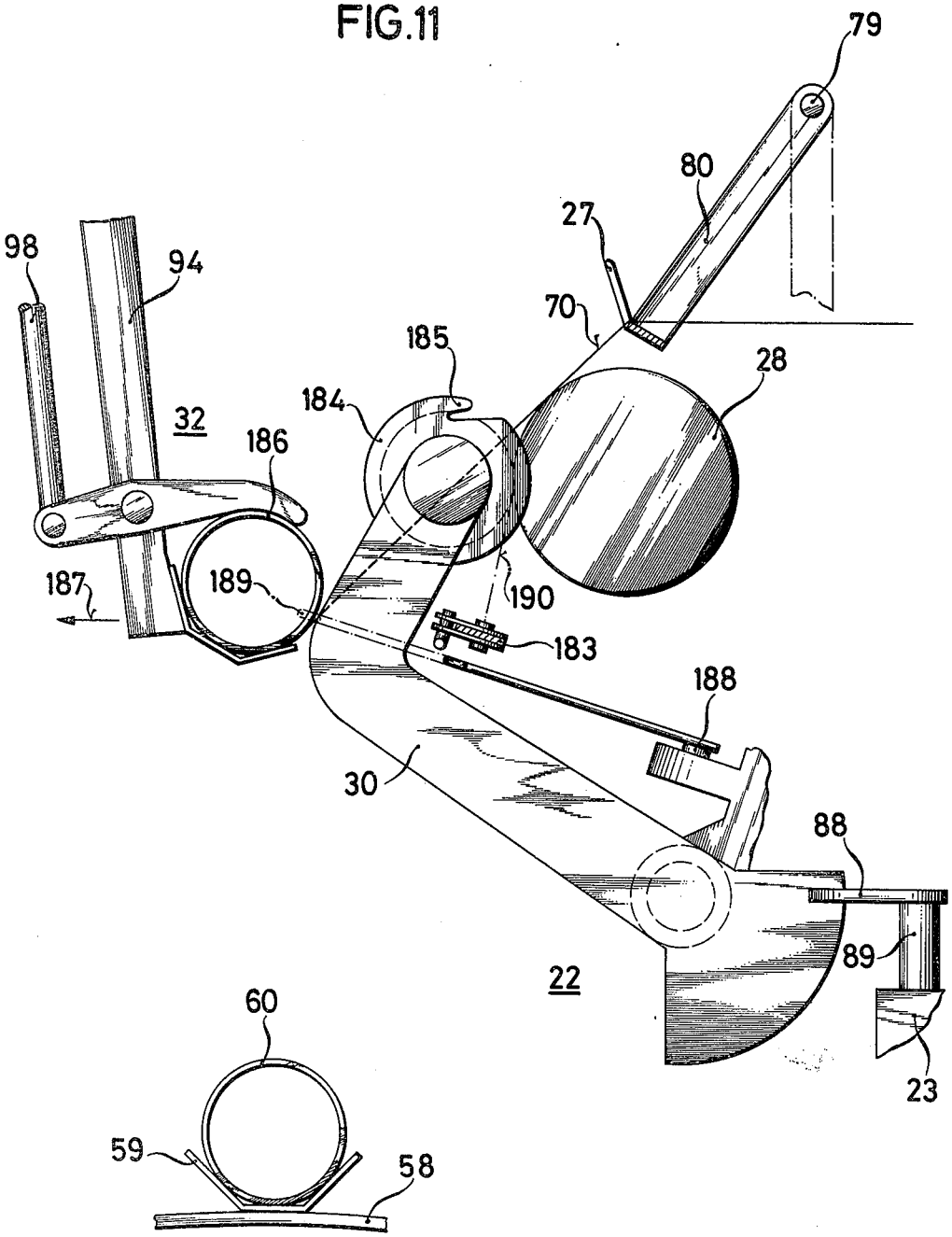

FIG. 11 is an enlarged fragmentary view of FIG. 1 showing details of an alternative embodiment of the separate, special winding device of the invention; and FIGS. 12 to 14, are fragmentary elevational views of FIG. 11 as seen from the left-hand side thereof, with the pivoted gripper omitted showing further details of the alternative embodiment in different modes of the operation thereof; and FIGS. 15 and 16 are end views and fragmentary sectional views, respectively, of the coil carrier of the embodiment of FIG. 11.

Referring now to the drawing and, first particularly to FIG. 1 thereof, there is shown a section of a winding machine which includes a multiplicity of individual winding stations, of which only five winding stations 1 to 5 are visible. Each winding station includes a reciprocating thread guide 6, a winding cylinder or roller 7 and a coil frame 8, into which take-up coils 9 to 13 of varying fullness of windings are inserted. By rolling around on the winding cylinder or roller 7, the take-up coils 9 to 13 are set into rotation, the thread 14, respectively, being wound thereon in the process. There is further shown in FIG. 1, a frame 15 of the winding machine and a track 16, on which a take-up coil-exchanging device 17 can travel past the winding stations on rollers 18 and 19.

Figure 2:
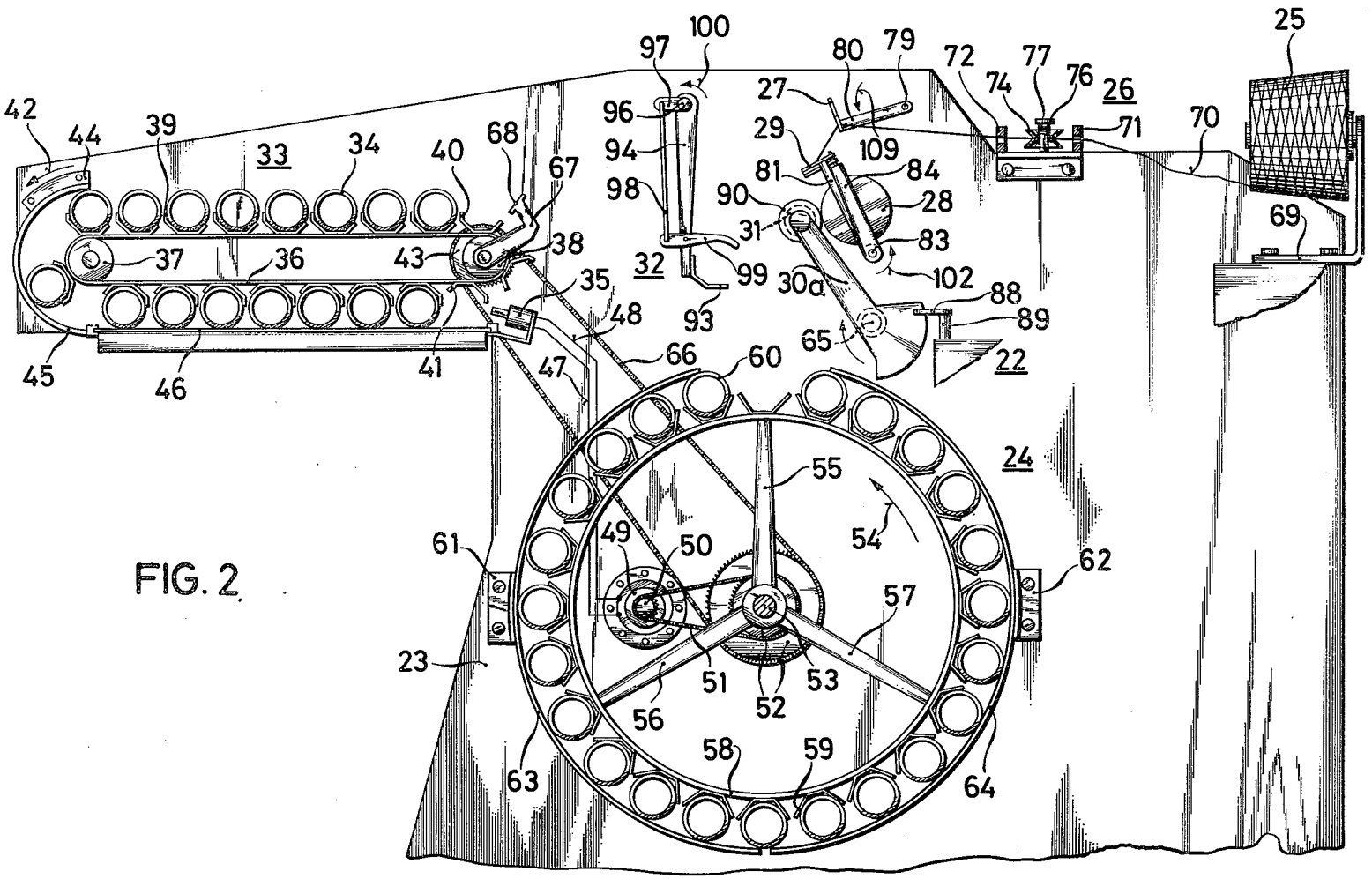
FIG. 2 is a diagrammatic view of the separate winding device as seen from the right-hand side of FIG. 1.

A magazine 20 and a tube or coil core feeder 21 are provided on the take-up coil-exchanging device 17. At the end of the winding machine, a separate, special winding device 22 is located, details of the construction of which may be seen especially in FIG. 2. A part 23 of the machine frame, a rotatable coil core magazine 24, a supply coil 25, a thread brake 26, a pivotable thread guide plate 27, a winding cylinder or roller 28, pivotable thread clamping shears or scissors 29, a pivotable tube or coil core support frame 30 with a coil core 31 clamped therein, a pivotable gripper 32 and a magazine 33 for starter coils 34, which are provided with a first winding and a thread reserve, are shown in FIG. 2. The aforementioned members 24 to 33 are connected to the machine frame part 23. Further details of construction of the winding device 22 are shown in FIGS. 3 to 7.

As shown in FIG. 2, the magazine 33 is formed of an endless conveyer belt 36 which is guided by a roller 37 and driven by a roller 38. On the conveyer belt 36, identical pockets or troughs 39, 40, 41 for receiving the starter coils 34 are mounted.

By means of a sprocket wheel 43 laterally secured to the roller 38, the conveyer belt 36 can be advanced step-by-step in the direction of the arrow 42. Due to a guide plate 45, fastened to the machine frame part 23 by a strap 44, and due to a slide 46, the starter coils 34 are prevented from falling out of the magazine 33.

As soon as a conventional sensor 35 shown in FIG. 2 has ascertained, for example, by feeling or by photoelectric means, that no starter coil is present in the pocket located in front of it, the sensor 35 transmits a starting signal to a motor 49 through conductor lines 47 and 48. The sprocket wheel 50 mounted on the shaft of the motor 49 thereupon drives a chain 51, which turns, in direction of arrow 54, the double sprocket wheel 52 fastened on the shaft 53 of the tube or coil core magazine 24. Three spokes 55, 56 and 57, also connected to the shaft 53, support a circular rim or hoop 58, on which identical coil-core pockets 59 are fastened, equally spaced from one another. Unwound or empty tubes or coil cores 60 are inserted in the pockets 59 and are prevented from falling out by guide plates 63 and 64 fastened to the machine frame 23 by means of straps 61 and 62. With every switching or indexing operation, the tube or coil-core magazine 24 is advanced 1/24 of the circumference thereof and, thereby, a coil core is always brought into the uppermost position, from which the coil-core frame 30, which is pivotable about a shaft 65, has previously taken the corresponding coil core 31, as shown in FIG. 2.

As the coil-core magazine 24 is further rotated, the sprocket wheel 43 and, thereby, the conveyer belt 36 are advanced the spacing of one pocket 59 by a chain 66, so that then an empty pocket 40 always comes to lie to the left-hand side, as viewed in FIG. 2, next to a roll-off surface 68, which is carried by the arm 67. The winding of the coil core 31 to make a starter coil and the insertion of the starter coil into the empty pocket 40 of the magazine 33 are effected in the following manner:

From the supply coil 25 carried by the bracket 69, that is connected to the machine frame 23, a textile thread 70 runs through the thread brake 26 and the thread-guide plate 27 to the thread clamping shears or scissors 29, which hold the end of the thread. The thread brake 26 is formed of two thread guides 71 and 72 and of two movable discs or plates 73 and 74, which are stuck on a mandrel 75 and are loaded by a spring 77, which can be adjusted by a set screw 76. The parts 71, 72 and 75 are held by a bracket 78 fastened to the machine frame 23. The thread-guide plate 27 is held by a lever 80, which is rotatably mounted on the machine frame 23 by means of a shaft 79. The clamping scissors 29 are articulatingly linked to the end of a bent lever 81, which is fastened to a hollow shaft 82. In a hollow shaft 82, a shaft 83 is coaxially disposed which also carries a lever 84 that is linked through a rod 85 to the movable blade of the thread-clamping shears or scissors 29.

Figure 3:
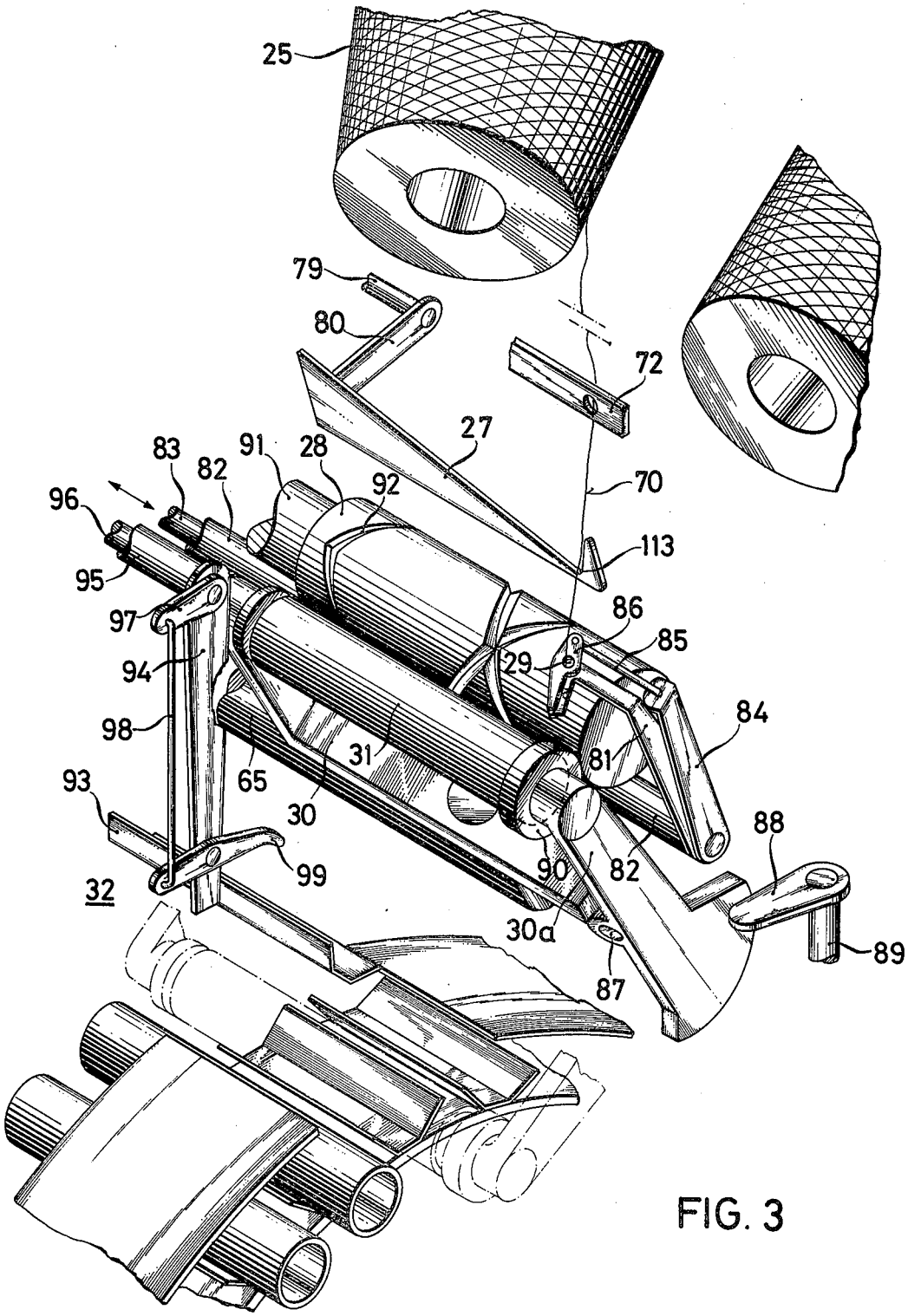
Figure 4:
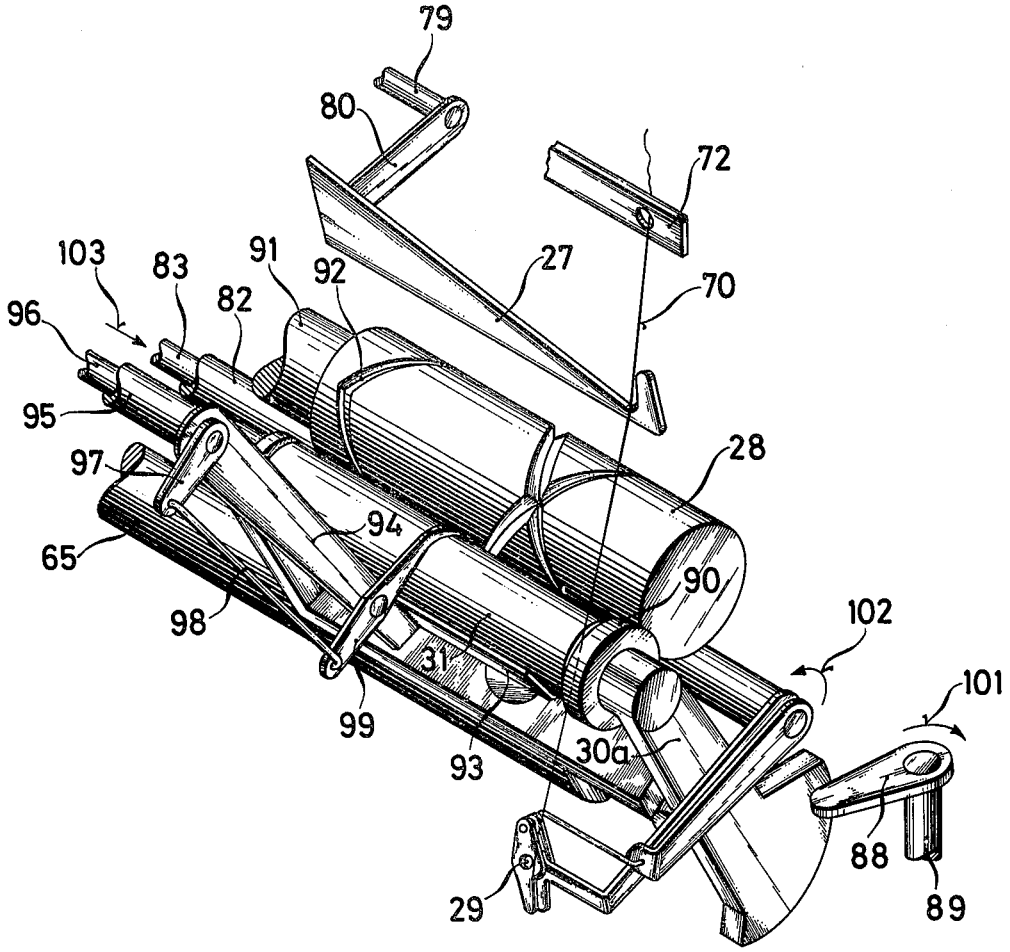

As is readily apparent, particularly from FIG. 3, the tube or coil core frame 30 has an articulating joint 87, about which an arm 30*a* of the coil-core frame 30 is pivotable. To swing or pivot the frame arm 30*a*, a lever 88 is rotated by a shaft 89. A coil core or tube carrier 90 fastened to the frame arm 30*a* and engaging cap-like over the end-face end of the coil core 31, accordingly releases the latter.

The winding roller or cylinder 28, fastened onto the shaft 91, rotates without interruption. It is provided with thread guiding grooves 92 which form a reversing thread. Before the coil-core frame 30 places the coil core 31 against the winding cylinder or roller 28, the tube or coil-core gripper 32 is initially actuated. The gripper 32 has a gripper tray 93 mounted at the end of a lever 94, which is fastened to a hollow shaft 95. Concentrically or coaxially mounted in the hollow shaft 95 is a shaft 96 which carries a lever 97 that is connected to a gripper lever 99 through an articulatingly suspended rod 98. By turning the hollow shaft 95 in the direction of the arrow 100 (FIG. 2), the gripper tray 93 is placed under the coil core 31, and by turning the shaft 96 in a direction opposite to that represented by the arrow 100, the gripper lever 99 is swung downwardly and retains the coil core 31 in the gripper tray 93, as is apparent from FIG. 4 of the drawing. At the same time, the shaft 89 is turned in the direction of the curved arrow 101 (FIG. 4), whereby the lever 88 is laid against the widened lower end of the frame arm 30*a* and thus opens the coil frame 30 somewhat. Simultaneously, the hollow shaft 82 and the shaft 83 are both rotated in the direction of the curved arrow 102, whereby the textile thread 70 extends into the region between the cap-like coil-core carrier 90 and the end face end of the coil core 31.

Thereupon, the coil frame 30 is again closed, the thread clamping shears or scissors 29 are opened by displacing or shifting the shaft 83 in the direction of the arrow 103 and, by rotation of the shaft 83 and the hollow shaft 82 in a direction opposite that represented by the arrow 102, the shears 29 are pivoted into the rest position and simultaneously, the gripper 32 is also returned to the rest position thereof, shown in FIG. 2.

Figure 6:
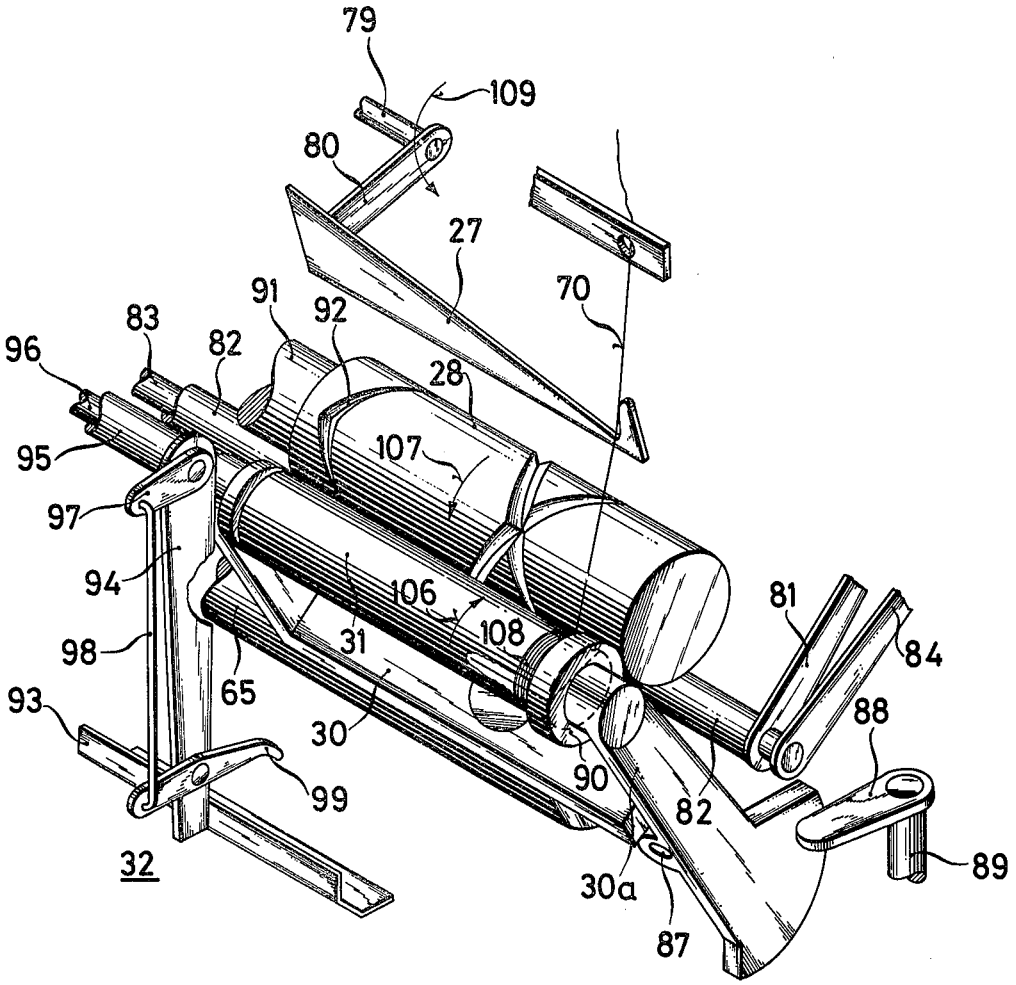
Figure 7:
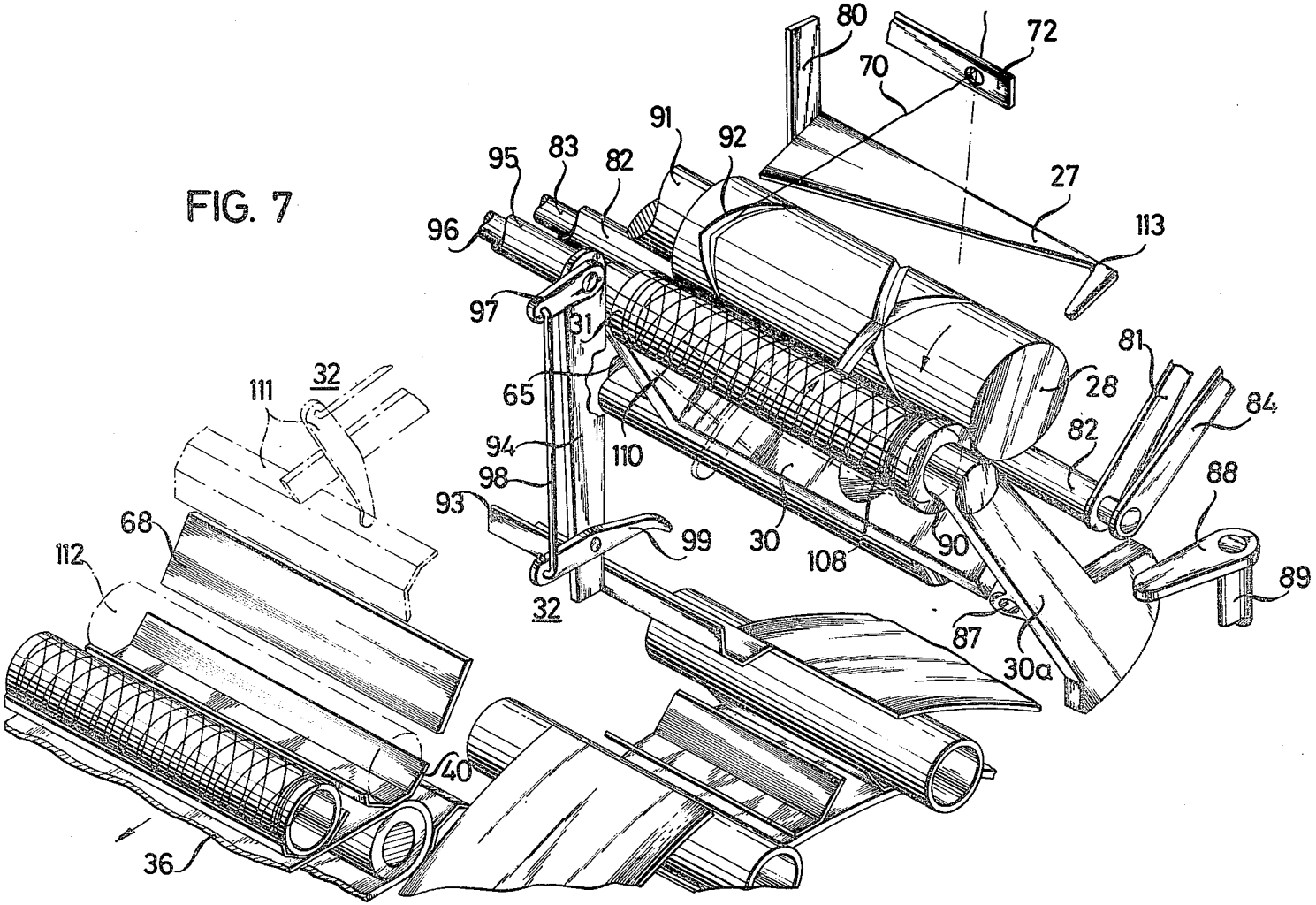

Upon closing the coil frame 30, the then-released starting end 105 of the textile thread 70 is clamped and deflected or bent between the edge of the cap 90*a* of the coil-core carrier 90 and the coil core 31 in such a manner that it points in direction toward the other end of the tube or coil core, as is shown, for example, in FIG. 5*a*. The instant at which the winding of a thread reserve just begins is captured in the view of FIG. 5. For this purpose, the textile thread 70 is guided by the thread guide plate 27, while the coil core 31 rotates in direction of the arrow 106, and the winding cylinder or roller 28 in direction of the arrow 107. In FIG. 6, that mode of the device of the invention is illustrated representing the instant when the winding of the thread reserve 108 has just been completed. The moment this has occurred, the shaft 79 is turned in direction of the arrow 109, the thread guide plate 27 being thereby swung downwardly, transferring the textile thread 70 to a thread guiding groove 92 of the winding roller 28, and initiating the formation of the first wrapping that is made up of a few windings of thread, as is readily seen particularly in FIG. 7. According to FIG. 7, the coil core 31 already possesses several thread windings 110, in addition to the thread reserve 108.

After the first wrapping is formed, the coil core 31 is lifted off the winding roller 28 due to rotation of the shaft 65, is gripped by the coil core gripper 32 through rotating the hollow shaft 95 and the shaft 96, is transported until it is above the roll-off surface 68 and is dropped there, the gripper 32 being in the indicated position 111 thereof, shown in phantom. In accordance with FIG. 7, the coil core that is provided with a thread reserve and a first wrapping of windings rolls over the roll-off surface 68 into the pocket 40 of the conveyer belt 36, where it occupies the position 112 thereof, shown in phantom. The gripper 32 is subsequently swung back again into the rest position shown in FIG. 2. By rotating the shaft 79 in a direction opposite that of the arrow 109, the thread guide plate 27 is initially raised only so high that the textile thread 70 again slides out of the thread guiding groove 92 of the winding roller 28 into the notch 113 of the thread guide plate 27. Then, the thread clamping shears or scissors 29 swing from the position thereof shown in FIG. 5 into that shown in FIGS. 2 and 3, grip the thread 70 again and sever it. Thus, a complete run or operational sequence in the production of a starter coil from the withdrawal of a coil core from the coil core magazine 24 to the transfer of the partially wound starter coil to the magazine 33 is completed. As can be seen from FIG. 2, the same operational sequence will be repeated immediately, because the next-succeeding coil core pocket 41 of the conveyer belt 36 is empty.

Figure 8:
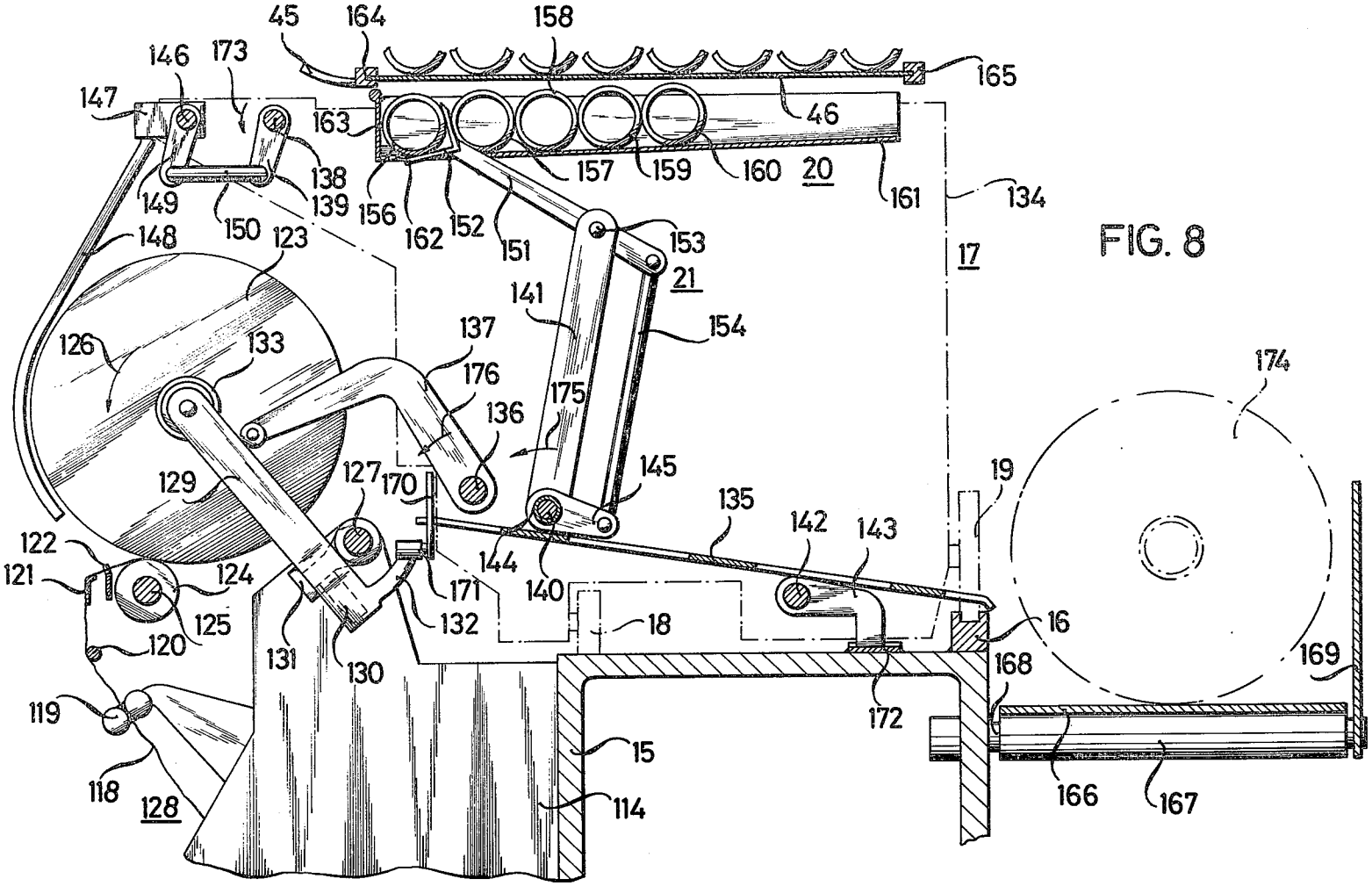
FIG. 8 is an enlarged diagrammatic side elevational view of one of the winding stations of the winding machine shown in FIG. 1 and of the traveling take-up coil-exchanging device.

In FIG. 8, the take-up coil-exchanging device 17 is shown in a rather simplified side view. There can further be seen in FIG. 8 a winding station 128 of the winding machien shown in FIG. 1. The winding station 128 has a housing 114 fastened to the machine frame 15. A thread 118 fed from a non-illustrated supply coil is guided by a thread guide wire 120, a guide bar or rail 121 and a reciprocating thread guide 122 and wound into a take-up coil 123, which has just reached its maximum fullness or fully wound condition and is to be exchanged for a starter coil. The take-up bobbin 123 is driven by a winding roller 124, which is fastened onto a shaft 125, and is set in rotation in direction of the arrow 126. A shaft 127 is rotatably mounted in the housing 114. A coil holder 129 is connected to the shaft 127 through an articulating joint 131 loaded by a leaf srping 130. The coil holder 129 carries an extension 132. The instant a force is exerted on the extension 132 in a direction perpendicular to the plane of the drawing of FIG. 8, the coil holder 129 can be withdrawn from the coil core 133 of the take-up coil 123 against the force of the leaf spring 130.

The housing 134 of the take-up coil exchanging device 17 must be though of as being located above the plane of the drawing, and the outline of the housing is therefore shown in dash-dot or phantom lines. The same applied to the rollers 18 and 19, on which the take-up coil-exchanging device 17 can travel on and along the machine frame 15 and the track 16. A roll-off plate 135 protrudes from the housing 134 in the direction of travel. A hold-down device 137 is fastened to a shaft 136. A lever 139 is fastened onto a shaft 138; a lever 141 onto a shaft 140; a detent lever 143 onto a shaft 142, and a lever 145 onto a hollow shaft 144. All of the shafts 138, 140, 142 and 144 protrude from the housing 134 in the travel direction. A base or foot 147 of a coil ejectro 148, rotatably mounted on a pin 146, has a lever 149, which is articulatingly linked to the lever 139 by means of a rod 150. A lever 151 of a gripper 152 is linked by a hinge pin 153 to the lever 141 and by means of a rod 154 to the lever 141 in such a manner that a parallel linkage for the gripper 152 is formed. The parts 151 to 154 form the coil core feeder 21. The take-up bobbin changing device 17 has the magazine 20 for receiving and dispensing starter coils 156 to 160 in the upper part thereof. The starter coils lie in a box 161, which has a slot 162 and a flap 163 to permit the gripper 152 to be swung in. Above the magazine 20 can be seen further parts, namely the guide plate 45, the slider 46 and two slider guides 164 and 165, which do not belong to the take-up coil-exchanging device 17, but to the magazine 33 of the separate, special winding device 22. Above the slider 46, a few starter coils can also be seen.

On the rear side of the machine frame 15, a coil conveyer belt 166 and one of the many conveyer rollers 167 are visible, the latter having an axle 168 which carries a guard plate 169 at one side thereof and being connected at the other side thereof to the machine frame 15.

The detent lever 143 of the take-up coil-exchanging device 17 is engaged, as shown in FIG. 8, in a detent 172 of the winding station 128 and a non-illustrated program control system of conventional construction for the take-up coil-exchanging device is thereby actuated. Such a program control system can readily be provided by a man of ordinary skill in the art in the form of suitable mechanical, electrocal or electronic timing or sequencing devices including appropriate cams or switches.

First, the winding process is interrupted. Then, a lever 170 connected to the housing 134 is swung in direction perpendicular to the plane of the drawing of FIG. 8, a roller 171 secured thereto being pressed against the extension 132 of the coil holder 129.

Accordingly, the coil holder 129 turns about the articulating joint 131, and the take-up coil 123 is seprated from the coil holder 129. Then, the lever 139 is swung in direction of the arrow 173 and back, whereby the coil ejector 148 throws the coil 123 onto the roll-off plate 135, from where it rolls onto the coil conveyer belt 166 and assumes the position 174 thereof shown in phantom. Then, the levers 141 and 145 are turned in direction of the arrow 175, whereby the gripper 152 feeds the coil core 156 to the coil holder 129. At the same time, the coil cores 157 to 160 roll forward in the box 155, which is installed at an inclined angle. The lever 170 is then swung back again, whereby the coil holder 129 receives the coil core 156. The thread 118 is now tied in a conventional manner to the thread coming from the non-illustrated supply coil, whereupon the hold-down device 137 is swung in direction of the arrow 176 and thus depresses the coil holder 129 until the coil core 156 rests on the winding roller 124. The winding process thus begins once more and, simultaneously, a new take-up coil is produced. After the gripper 152 has been returned to the starting position thereof, shwon in FIG. 8, the detent lever 143 can be disengaged again and the take-up coil-exchanging device 17 can be moved to another winding station.

With reference to FIGS. 8 to 10 of the drawing, the manner in which the transfer of the coil cores from the magazine 33 of the separate, special winding device 24 to the magazine 20 of the take-up coil-exchanging device 17, is accomplished, is explained hereinafter. As can be seen in FIG. 8, the box or casing 161 of the magazine 20 is located somewhat below the slide 46 of the magazine 33. The slide 46 has two tabs 177 and 178, which project downwardly between the slide guides 164 and 165. As is apparent from FIG. 9, the tab 177 is in the position 179, shown in broken lines, as long as the slider 46 is closed. The moment the box 161 which is secured to the housing 134 of the take-up coil-exchanging device 17, and which belongs to the magazine 20, approaches the magazine 33, the wall 180 of the box 161 engages the tab 177 of the slider 46, and the latter is pushed aside completely and opened when the take-up coil-exchanging device 17 travels onwardly, as shown in FIG. 9. As soon as the box 161 is under the magazine 33, as many take-up coils as the box 161 can hold drop from the magazine 33 into the box 161.

At the start of the return trip of the take-up coil-exchanging device 17 in direction of the arrow 181, a plunger 182 is initially driven out of the housing 134, slides behind the tab 178 of the slider 46 and closes the slider again when the take-up coil-exchanging device 17 travels on. Any excess starter coils then slide back into the magazine 33 of the winding device at the inclined surface of the tab 177, as shown in FIG. 10.

In FIGS. 11 to 16 of the drawing, details of another embodiment of the special winding device 22 are shown. In FIG. 11, one can again see the rim 58 of the coil core magazine 24 with the coil core pocket 59 and an empty coil core 60. The textile thread 70 guided by the thread guide plate 27 remains connected to a coil core 186. A coil core carrier 184, rotatably mounted at an end of the coil core frame 30, is formed, as can be ssen particularly in FIGS. 15 and 16, of a centering cone 194 with an engagement surface 196, and a clamping member 195 mounted so as to be displaceable relative thereto and also having a mating engagement surface in the are of contact thereof with the centering cone 194. Between the centering cone 194 and the clamping member 195, an energy storage device in the form of a compression spring 197 which, in released condition, keeps the two parts apart, is located.

The centering cone 194 is guided by a pin 199 connected with the clamping member 195 and is secured against sliding off the pin 199 by a washer 200 fastened to the pin 199.

At the periphery of the clamping member 195, a catch projection or nose 185 is disposed in such a manner that a thread capturing slot 198 defined by the catch projection 185 and the clamping member 195 intersects with the mating engagement surface 196 at an acute angle.

Referring to FIG. 11, the coil frame 30 can be opened and closed by means of the lever 88, as previously described herein in connection with FIG. 3. Since the coil core carrier 184 happens to carry no coil, the winding roller 28 idles. The gripper 32 has just taken the starter bobbin, that is provided with a thread reserve and a first wrapping of windings from the coil-core carrier 184, and transports the starter coil in direction of the arrow 187. A thread gripper 189 fastened onto the shaft 188 stands ready to grip the textile thread 70 immediately and to feed it to stationary clamping shears or scissors 183, which seize the thread, clamp and sever it, whereupon the thread assumes the position 190 thereof shown in phantom. Thereafter, the coil frame 30 is swung downwardly, whereupon the coil-core carrier 184 removes the empty coil core 60 from the coil core pocket 59 and places it against the winding roller 28, as shown in FIG. 12. The thread gripper 189 has, in the interim, been swung back into the starting position thereof. As soon as the coil core 60 starts to turn, the catch projection 185 seizes the textile thread 70, whereby the end of the thread is pulled out of the clamping scissors 183 and the thread is clamped between the catch projection 185 and the mating engagement surface 196 of the cnetering cone 194. Then, the winding of the thread reserve begins. Even as the first winding occurs, the thread end is secured by overwinding, as is shown in FIG. 13.

For the purpose of forming the thread reserve, a separate thread guiding groove 191 is provided on the winding roller 28. As soon as the thread reserve is wound, the thread guide plate 27 swings downwardly, whereby the thread is passed on to the thread guiding grooves 92 of the winding roller 28, which form a reversing thread, so that a first wrapping of windings is produced, as explained hereinbefore in detail in connection with FIG. 7. In FIG. 14, the coil core 60 is shown already carrying a thread reserve 192 and a first layer or wrapping 193 of windings and has therefore become a starter coil. In FIGS. 15 and 16, the coil carrier 184 with the catch projection 185 is shown in actual size, in a side view and in a longitudinal cross-sectional view. In addition, there are also shown part of the coil core 60, the thread reserve 192 and the thread end 201, which is clamped between the mating engagement surface 196 of the centering cone 194 and the catch projection 185 of the clamping member 195.

The time sequence and the duration of the aforedescribed operations can be assured, as aforementioned, by programmed timing or switching mechanisms, such as cam timing mechanisms, for example, which are not discussed herein in detail as they are assumed to be well known in the art.

There are claimed:

1. Method of increasing the speed at which take-up coils are exchanged at winding stations of a winding machine for textile threads which comprises, prior to exchanging a take-up coil at a respective winding station, winding a few thread windings on a coil core to form a starter coil in a winding device located at the winding machine but separate from the respective winding station; exchanging a fully wound take-up coil at the respective winding station for the starter coil previously formed on the separate winding device; tying a thread end of the starter bobbin to a thread end of a supply coil fed to the respective winding station; and setting the respective winding station in operation for winding thread on the starter coil to form a fully wound take-up coil.

2. Method according to claim 1 which comprises winding a thread reserve on the coil core and thereafter forming the starter coil prior to exchanging the take-up coil.

3. Method according to claim 2 wherein the thread end of the starter coil is secured by winding thereover, on the coil core, windings of the thread forming the thread reserve.

4. Method according to claim 3 which comprises, inserting an unwound core into the separate winding device, guiding the thread to be wound in a few windings thereon initially across the end face of the core, then clamping the core with a clamping device at the end face thereof so that the thread is clamped therebetween with a free end thereof disposed along the winding surface of the core for winding over the free end, on the coil core, windings of the thread forming the thread reserve.

5. Method according to claim 3 which comprises withdrawing the thread to be wound in the separate winding device from a supply coil by means of clamping shears and a thread gripper and delivering the thread into a region wherein it is interceptible by a thread capturing and clamping device located at a support frame for the core, gripping the thread by means of the catching and clamping device while the coil core is simultaneously rotated, pulling the thread end out of the clamping shears and securing it to the coil core so that windings of the thread forming the thread reserve can be wound over the thread end on the coil core.

6. Method according to claim 1 which comprises winding the starter coil at one end of the winding machine at which the separate winding device is located.

7. Method according to claim 1 which includes intermittently filling a magazine for starter coils to be exchanged for the fully wound take-up coils at the respective winding stations with starter coils formed in the separate winding device.

8. Method according to claim 7 which includes intermittently delivering a plurality of the starter coils simultaneously from the separate winding station to a traveling coil exchanging device with which the magazine is associated.

9. Method according to claim 7 which includes initially storing the starter coils formed in the separate winding device in another magazine associated with the separate winding device and thereafter filling the first-mentioned magazine with the starter coils from the other magazine.

10. In combination, a winding machine having a plurality of winding stations which utilize starting coils wound on cores for winding textile threads and a device for increasing the speed at which take-up coils are exchanged at winding stations of the winding machine for textile threads comprising winding means adjacent to but separate from the winding machine for forming starter coils having a few thread windings thereon.

11. Device according to claim 10 wherein said separate winding means is located at one end of the winding machine.

12. Device according to claim 10 wherein said separate winding means comprises a magazine for storing at least one of the formed starter coils therein.

13. Device according to claim 10 including a traveling coil exchanging device movable from winding station to winding station for exchanging fully wound take-up coils wound at the respective stations, said coil exchanging device having a magazine for receiving therein at least one starter coil formed by said separate winding means.

14. Device according to claim 10 wherein said separate winding means includes thread guiding means for winding a thread reserve on the respective cores at one side thereof, and means for securing the thread end in the wound thread reserve.

15. Device according to claim 14 wherein said thread guiding means secures the starting end of the thread by winding thereover on the coil core windings of the thread forming the thread reserve.

16. Device according to claim 10 wherein said separate winding means include clamping means for clamping the thread against the end face of the coil core and for diverting the starting end of the thread in a direction along the cylindrical surface of the core.

17. Device according to claim 10 wherein said separate winding means includes means for carrying the coil core during formation of the starter coils, said coil-core carrying means having a thread-capturing and clamping device.

18. Device according to claim 17 wherein said thread-capturing and clamping device comprises a catch projection extending from said coil-core carrying means in a direction wherein the coil core is rotatable.

19. Device according to claim 18 wherein said thread capturing and clamping device is automatically releasable upon the release of the respective coil core.

20. Device according to claim 18 wherein said coil-core carrying means comprise a centering cone and a clamping member movable relatively toward and away from one another, both said centering cone and said clamping member having mating engagement surfaces in a mutual region of engagement.

21. Device according to claim 20 including at least one energy storage device disposed between and separating said centering cone and said clamping member.

22. Device according to claim 21 wherein said engergy storage device is a compression spring.

23. Device according to claim 21 wherein said catch prejection is located at the periphery of said clamping member, said catch projection and said clamping member defining a thread capturing slot therebetween, said slot intersecting with the engagement surface of said centering cone at an acute angle.

24. Device according to claim 18 including clamping shears located directly behind said core carrying means in thread withdrawal direction.

* * * * *